US008049483B2

(12) United States Patent
Yamamoto et al.

(10) Patent No.: US 8,049,483 B2
(45) Date of Patent: Nov. 1, 2011

(54) REFERENCE VOLTAGE GENERATION CIRCUIT AND BIAS CIRCUIT

(75) Inventors: Kazuya Yamamoto, Tokyo (JP); Miyo Miyashita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 438 days.

(21) Appl. No.: 12/417,730

(22) Filed: Apr. 3, 2009

(65) Prior Publication Data

US 2010/0127689 A1 May 27, 2010

(30) Foreign Application Priority Data

Nov. 21, 2008 (JP) ..... 2008-298431

(51) Int. Cl.
*G05F 3/16* (2006.01)

(52) U.S. Cl. ..... 323/313; 327/538

(58) Field of Classification Search ..... 323/311–316; 327/530, 538

See application file for complete search history.

(56) References Cited

U.S. PATENT DOCUMENTS

| | | | | |
|---|---|---|---|---|
| 4,891,729 | A * | 1/1990 | Sugiyama et al. | 361/56 |
| 5,153,500 | A * | 10/1992 | Yamamoto et al. | 323/314 |
| 6,204,724 | B1 * | 3/2001 | Kobatake | 327/541 |
| 6,323,630 | B1 * | 11/2001 | Banba | 323/313 |
| 6,946,913 | B2 | 9/2005 | Moriwaki et al. | |
| 7,005,839 | B2 * | 2/2006 | Wada | 323/316 |
| 7,782,042 | B2 * | 8/2010 | Fukuzawa | 323/314 |
| 2007/0159145 | A1 | 7/2007 | Liwinski | |
| 2008/0111525 | A1 * | 5/2008 | Fukuzawa | 323/273 |

FOREIGN PATENT DOCUMENTS

JP 2004-343244 A 12/2004

* cited by examiner

*Primary Examiner* — Adolf Berhane
(74) *Attorney, Agent, or Firm* — Leydig, Voit & Mayer, Ltd.

(57) ABSTRACT

A reference voltage generation circuit comprises: a first depletion mode FET; a second depletion mode FET; a first resistor; a first bipolar transistor; a second resistor; a second bipolar transistor; a third bipolar transistor; a third resistor; a third depletion mode FET having its drain connected to a second end of the first resistor and to the collector of the first bipolar transistor; and a fourth bipolar transistor having its base and collector connected to the gate and the source of the third depletion mode FET, and its emitter grounded, wherein source voltage of the second depletion mode FET is output as a reference voltage.

9 Claims, 12 Drawing Sheets

REFERENCE VOLTAGE GENERATION CIRCUIT AND BIAS CIRCUIT

BACKGROUND OF THE INVENTION

1. Field of the Invention

The present invention relates to a reference voltage generation circuit and a bias circuit formed by using a BiFET process and, more particularly, to a reference voltage generation circuit and a bias circuit capable of suppressing a variation in gain due to a process variation.

2. Background Art

Conventional GaAs-FET power amplifiers have a negative threshold voltage and therefore have the drawback of requiring a negative gate bias voltage. In contrast, GaAs heterojunction bipolar transistor (GaAs-HBT) power amplifiers require no negative gate bias voltage, are capable of single power supply operation and have more uniform device characteristics in comparison with FET power amplifiers. For this reason, use of GaAs-HBT power amplifiers in CDMA portable telephones, wireless LAN devices, etc., has been markedly increased (see, for example, US2007/0159145-A1 and Japanese Patent Laid-Open No. 2004-343244).

A BiFET process for making a FET together with a GaAs-HBT on one substrate has recently been applied to products. Ordinarily, in a GaAs BiFET process, an HBT and a depletion mode (normally on) FET are mounted. Further, a process in which an enhancement-mode (normally off) FET is made in addition to an HBT and a depletion mode FET on one substrate has recently been reported in the learned circle (IEEE: Radio Frequency Integrated Circuits Symposium 2008).

SUMMARY OF THE INVENTION

FIG. 12 is a block diagram showing a GaAs power amplifier using a BiFET process. An initial amplification stage A1 and a following amplification stage A2 are connected in series. A first bias circuit B1 and a second bias circuit B2 respectively supply bias voltages to the initial amplification stage A1 and the following amplification stage A2. A reference voltage generation circuit VG generates a reference voltage required for the first bias circuit B1 and the second bias circuit B2 to generate the bias voltages.

A switch F which forms a bypass around the following amplification stage A2 has its gate connected to a control terminal Vcon through a resistor Rg, its drain connected to the input side of the following amplification stage A2 through a capacitor Cc1, and its source connected to the output side of the following amplification stage A2 through a capacitor Cc2. A resistor Rd is connected between the source and the drain of the switch F. During low-output operation, the operation of the following amplification stage A2 is stopped and the output from the initial amplification stage A1 flows through the switch F bypassing the following amplification stage A2 to be directly output. The power consumption during low-output operation can be reduced in this way.

Each of the initial amplification stage A1 and the following amplification stage A2 is constituted by a GaAs-HBT. On the other hand, FETs are used in the first bias circuit B1, the second bias circuit B2, the reference voltage generation circuit VG and the switch F. The reference voltage generation circuit and other circuits using FETs had been made by a process different from that for forming the GaAs-HBT. Use of different processes had been a hindrance to the reduction in size of power amplifier modules. With the application of a BiFET process, however, schemes to improve the functions of power amplifier modules have started advancing rapidly.

FIG. 13 is a circuit diagram showing a reference voltage generation circuit relating to the reference example. FIG. 14 is a circuit diagram showing a current-mirror-type bias circuit relating to the reference example. FIG. 15 is a circuit diagram showing an emitter-follower-type bias circuit relating to the reference example. In the figures, F1, F2, F5 and F6 denote depletion mode FETs; Tr, Tr1, Tr5 and Tr8 to Tr12 denote HBTs; R1 to R3, R7 to R10, R14, R15 and R19 to R22 denote resistors; D denotes a diode; Vcb and Vc denote power supply terminals; Ven denotes an enable terminal to which an enable voltage is applied; and Vref denotes a reference voltage terminal to which a reference voltage is applied.

FIG. 16 is a diagram showing an enable voltage dependence of a reference voltage of the reference voltage generation circuit shown in FIG. 13. The enable voltage is changed, for example, from 0 V to 3 V in a sweeping manner. If the threshold voltage Vth of the depletion mode FETs is about −0.8 V, an ON voltage Va in the enable voltage at which the circuit is made usable is about 1.3 to 2.0 V. In general, if the voltage Va is set lower under a condition that the power supply voltage applied to the power supply terminal Vcb is higher than a design reference voltage, the reference voltage becomes lower. If the voltage Va is set higher, the reference voltage becomes higher. For example, when the voltage Va is set to a low voltage of about 1.4 V, the reference voltage is about 2 V. When the voltage Va is set to about 2 V, the reference voltage is 2.7 to 2.8 V. This is because the gate voltage of F1 is determined by the enable voltage, and because the source voltage of F2 connected to the source side of F1, i.e., the reference voltage, is determined by the gate voltage of F1 and the threshold voltage Vth of the FETs.

FIG. 17 is a diagram showing an enable voltage dependence of the collector current in a case where the bias circuit shown in FIG. 14 or 15 is connected to the reference voltage generation circuit shown in FIG. 13. The collector current of the transistor in the amplification stage rises according to the rise of the reference voltage.

FIG. 18 is a diagram showing an enable voltage dependence of the output current of the bias circuit in a case where the bias circuit shown in FIG. 14 or 15 is connected to the reference voltage generation circuit shown in FIG. 13. When the enable voltage is 0 V, the output current Ib of the bias circuit is sufficiently low current on order of microamperes or lower and the circuit is in the off state.

With the circuit shown in FIG. 13 and FIG. 14 or 15, there is a problem that if the threshold voltage Vth of the depletion mode FETs varies, the reference voltage and the collector current Ic vary largely, as shown in FIGS. 16, 17 and 18. For example, if the standard value of Vth of the depletion mode FETs is −0.8 V, the collector current Ic varies by about ±30 mA about the standard current of 40 mA with variation in Vth through the range between −1.0 V (deep) and −0.6 V (shallow). In general, the magnitude of an idle current in a power amplifier (a bias current when there is no RF input power) determines the magnitude of the linear gain. Therefore, suppression of a variation in gain due to a process variation is one of important design challenges.

Also, if the leak current when the enable voltage is 0 V is suppressed to a value on the order of microamperes or lower, there is ordinarily a limit of about 1.4 V to the voltage Va as described above. However, since the power supply voltage for the baseband LSI that outputs the enable voltage is reduced with the reduction in Si-CMOS process rule, the upper limit of the output voltage of the baseband LSI, i.e., the enable voltage, is also reduced. For example, a demand has arisen for 1.3 V or less as the voltage Va.

In view of the above-described circumstances, a first object of the present invention is to provide a reference voltage generation circuit and a bias circuit capable of suppressing a variation in gain due to a process variation.

A second object of the present invention is to provide a reference voltage generation circuit and a bias circuit capable of reducing the enable voltage for setting a circuit in a usable state.

According to one aspect of the present invention, a reference voltage generation circuit comprises: a first depletion mode FET having its gate connected to an enable terminal, and its drain connected to a power supply terminal; a second depletion mode FET having its drain connected to a source of the first depletion mode FET; a first resistor having its one end connected to a source of the second depletion mode FET, and the other end connected to a gate of the second depletion mode FET; a first bipolar transistor having its collector connected to the other end of the first resistor; a second resistor having its one end connected to an emitter of the first bipolar transistor, and the other end grounded; a second bipolar transistor having its collector connected to the source of the first depletion mode FET, and its base connected to the source of the second depletion mode FET; a third bipolar transistor having its base and collector connected to a base of the first bipolar transistor and to an emitter of the second bipolar transistor; a third resistor having its one end connected to an emitter of the third bipolar transistor, and the other end grounded; a third depletion mode FET having its drain connected to the other end of the first resistor and to the collector of the first bipolar transistor; and a fourth bipolar transistor having its base and collector connected to a gate and a source of the third depletion mode FET, and its emitter grounded, wherein a source voltage of the second depletion mode FET is output as a reference voltage.

The present invention enables suppression of a variation in gain due to a process variation.

Other and further objects, features and advantages of the invention will appear more fully from the following description.

DETAILED DESCRIPTION OF THE PREFERRED EMBODIMENTS

First Embodiment

Figure 1:
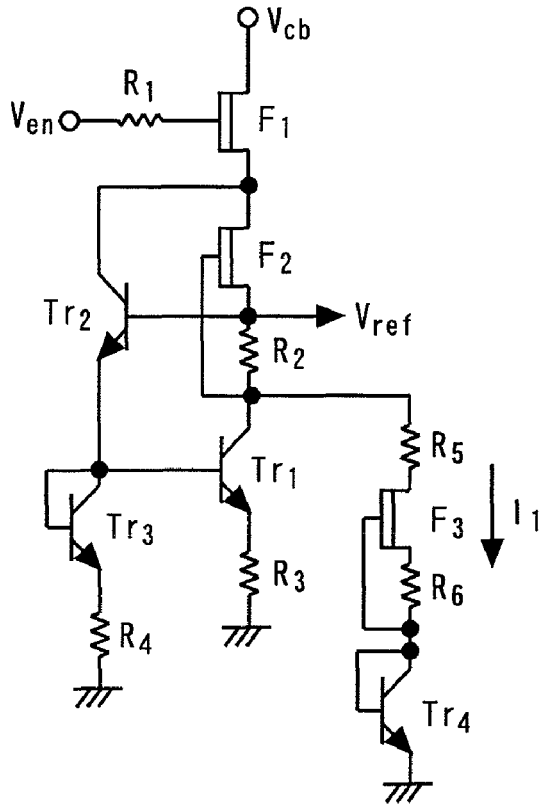
FIG. 1 is a circuit diagram showing a reference voltage generation circuit according to a first embodiment of the present invention.

FIG. 1 is a circuit diagram showing a reference voltage generation circuit according to a first embodiment of the present invention. This circuit is formed by using a BiFET process. In FIG. 1, F1 to F3 denote depletion mode FETs; Tr1 to Tr4 denote HBTs; R1 to R6 denote resistors; Vcb denotes a power supply terminal; Ven denotes an enable terminal to which an enable voltage is applied; and Vref denotes a reference voltage terminal to which a reference voltage is applied.

F1 has its gate connected to the terminal Ven through the resistor R1, and its drain connected to the power supply terminal Vcb. The drain of F2 is connected to the source of F1. One end of R2 is connected to the source of F2, while the other end of R2 is connected to the gate of F2. The collector of Tr1 is connected to the other end of R2. One end of R3 is connected to the emitter of Tr1, while the other end of R3 is grounded. Tr2 has its collector connected to the source of F1, and its base connected to the source of F2. Tr3 has its base and collector connected to the base of Tr1 and to the emitter of Tr2. One end of R4 is connected to the emitter of Tr3, while the other end of R4 is grounded. This reference voltage generation circuit outputs the source voltage of F2 as a reference voltage through the terminal Vref. A resistor may be connected between the base of Tr2 and the source of F2.

A threshold voltage compensation circuit for compensating the threshold voltage Vth of the depletion mode FETs has F3, R5, R6 and Tr4. F3 has its drain connected to the other end of R2 and to the collector of Tr1 through R5. Tr4 has its base and collector connected to the gate of F3 and also to the source of F3 through R6. Tr4 has its emitter grounded. The resistors R5 and R6 may be removed, depending on the design.

With variation in threshold voltage Vth of F2, the value of a current I1 drawn out by the threshold voltage compensation circuit including F3 having the same threshold voltage Vth changes. For example, when the threshold voltage Vth is deep, the reference voltage increases in the circuit relating to the reference example and shown in FIG. 13 to increase the collector current of the transistor in the amplification stage. In the present embodiment, when the threshold voltage Vth is deep, the drawn-out current I1 in the threshold voltage compensation circuit increases. The current flowing through Tr1 and R3 is reduced thereby. Suppression of an increase in voltage at the collector end of Tr1 is thus enabled. Consequently, increases in the reference voltage and the collector current can be suppressed. Thus, the circuit according to the present embodiment can suppress a variation in gain due to a process variation.

Figure 2:
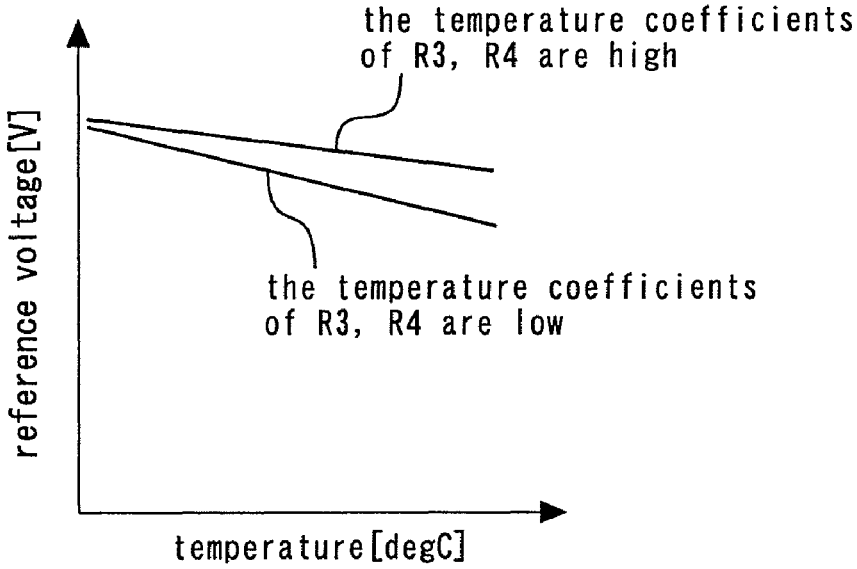
FIG. 2 is a diagram showing an example of a temperature characteristic of the reference voltage of the circuit shown in FIG. 1.
Figure 13:
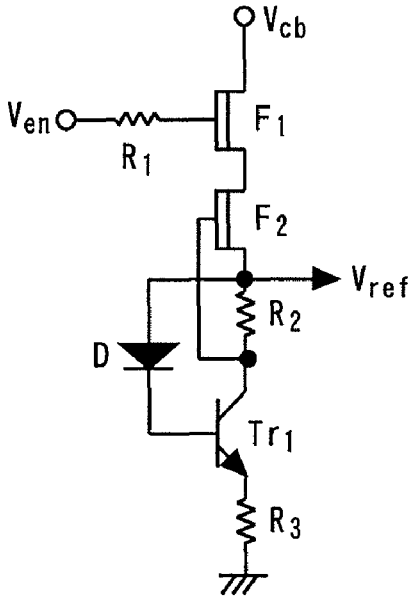
FIG. 13 CONVENTIONAL ART
FIG. 13 is a circuit diagram showing a reference voltage generation circuit relating to the reference example.

The reference voltage generation circuit according to the first embodiment has a current-mirror circuit constituted by Tr1 and Tr3 unlike the circuit relating to the reference example and shown in FIG. 13. While it is preferred that the temperature coefficient of a resistor is lower, R3 and R4, which are emitter resistors for Tr1 and Tr3, have a high positive temperature coefficient in the present embodiment. Increasing the positive temperature coefficient of a resistor in a BiFET process can be easily achieved not by using a metal resistor but by using an epitaxial resistor in the base layer (semiconductor layer). FIG. 2 is a diagram showing an example of a temperature characteristic of the reference voltage of the circuit shown in FIG. 1. A change in the reference voltage with respect to temperature can be suppressed by increasing the temperature coefficient of R3 and R4 as shown in FIG. 2.

Further, the circuit according to the present embodiment is capable of suppressing the leak current when the enable voltage is 0 V to several microamperes or less if the threshold voltage Vth of the depletion mode FETs is higher than 1.0 V, and if the built-in voltage of the HBTs is about 1.25 V. That is, the circuit according to the present embodiment has a shutdown mode.

Second Embodiment

Figure 3:
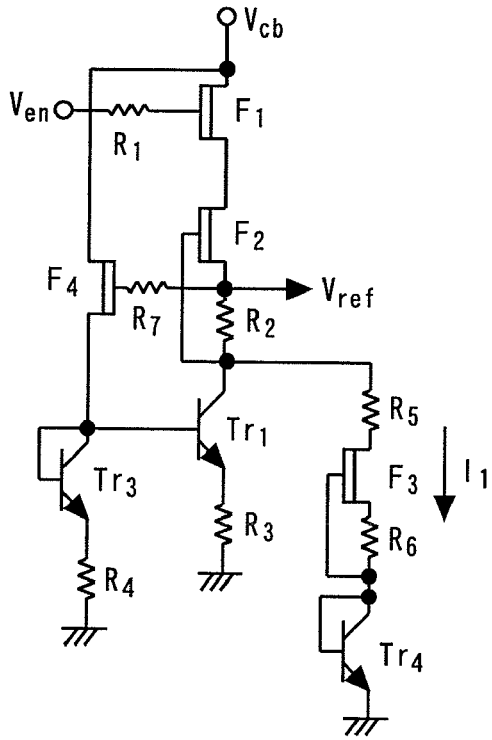
FIG. 3 is a circuit diagram showing a reference voltage generation circuit according to a second embodiment of the present invention.

FIG. 3 is a circuit diagram showing a reference voltage generation circuit according to a second embodiment of the present invention. This circuit has such a configuration that Tr2 in the first embodiment is replaced with F4 which is a depletion mode FET. In other respects, the configuration is the same as that in the first embodiment. More specifically, F4 has its drain connected to the power supply terminal Vcb, and its gate connected to the source of F2 through the resistor R7. Tr3 has its base and collector connected to the source of F4.

The ON voltage Va in the enable voltage can be reduced to about 1.4 V lower than about 2 V in the first embodiment by using the depletion mode FET F4. Other advantages, which are the same those of the first embodiment, can also be obtained.

Third Embodiment

Figure 4:
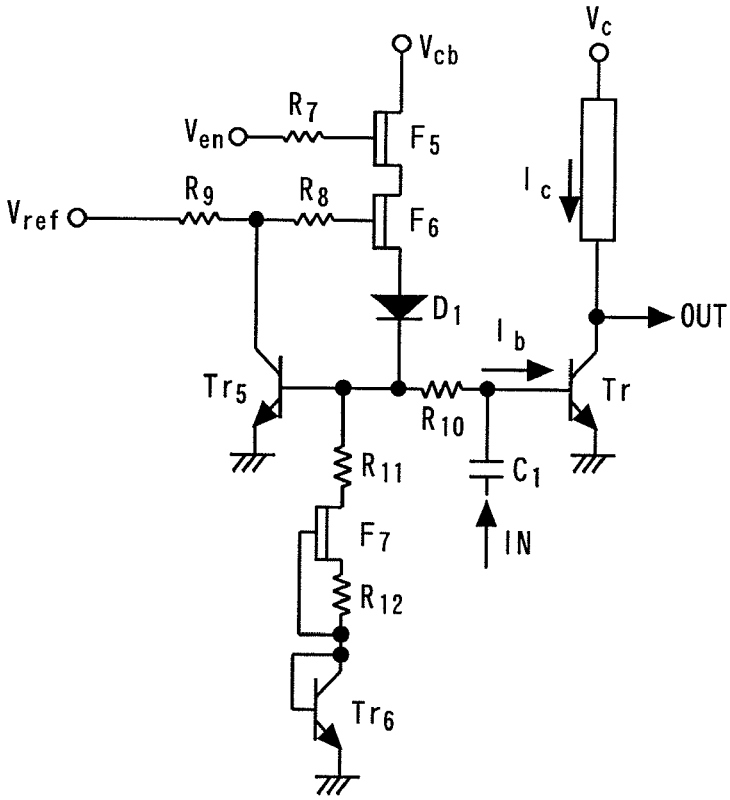
FIG. 4 is a circuit diagram showing a bias circuit according to a third embodiment of the present invention.
Figure 14:
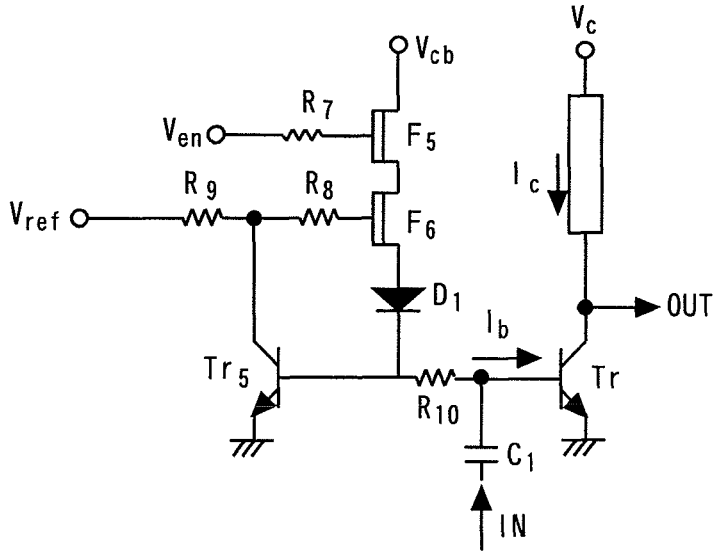
FIG. 14 CONVENTIONAL ART
FIG. 14 is a circuit diagram showing a current-mirror-type bias circuit relating to the reference example.
Figure 15:
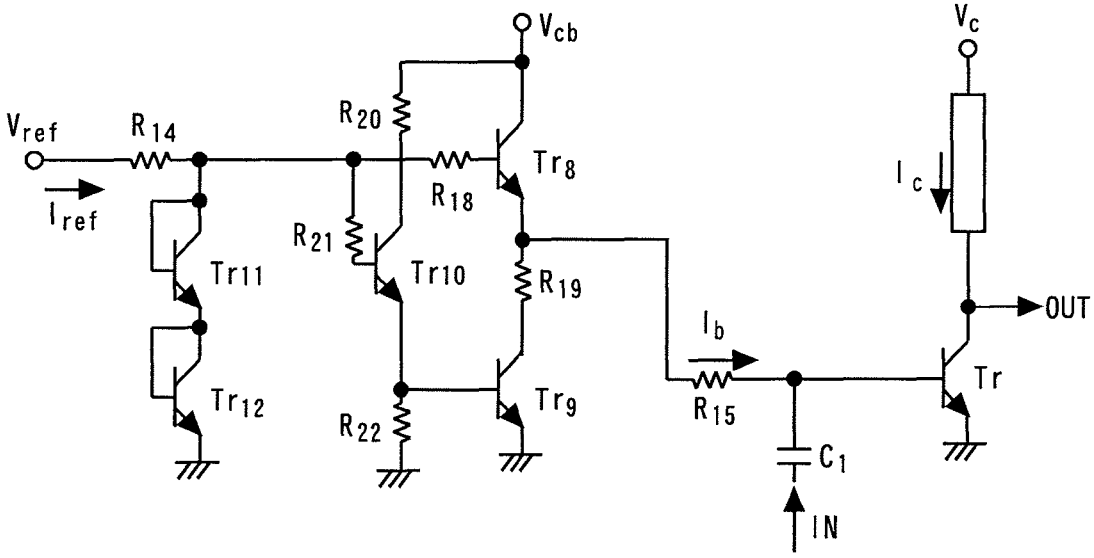
FIG. 15 CONVENTIONAL ART
FIG. 15 is a circuit diagram showing an emitter-follower-type bias circuit relating to the reference example.
Figure 16:
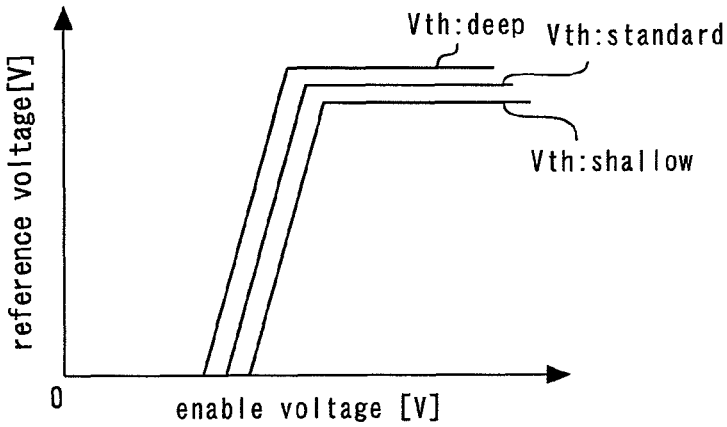
FIG. 16 CONVENTIONAL ART
FIG. 16 is a diagram showing an enable voltage dependence of a reference voltage of the reference voltage generation circuit shown in FIG. 13.
Figure 17:
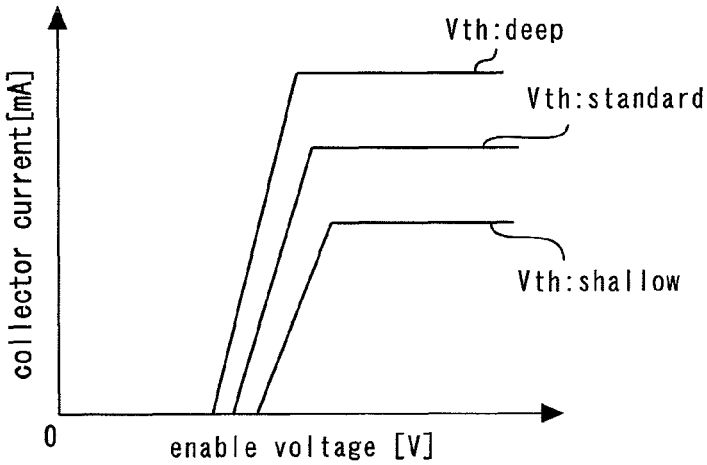
FIG. 17 CONVENTIONAL ART
FIG. 17 is a diagram showing an enable voltage dependence of the collector current in a case where the bias circuit shown in FIG. 14 or 15 is connected to the reference voltage generation circuit shown in FIG. 13.
Figure 18:
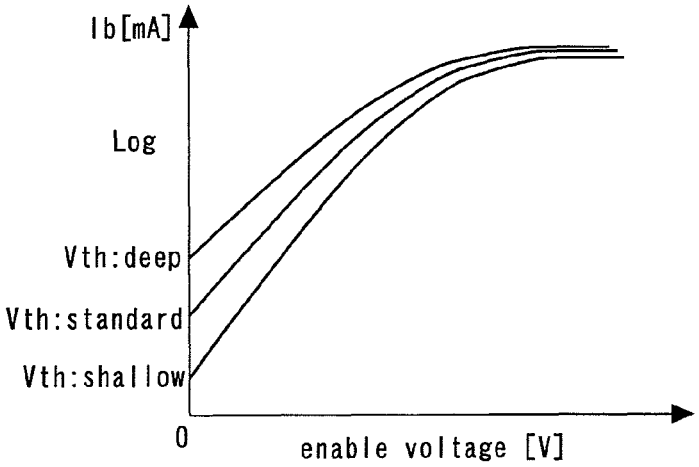
FIG. 18 CONVENTIONAL ART
FIG. 18 is a diagram showing an enable voltage dependence of the output current of the bias circuit in a case where the bias circuit shown in FIG. 14 or 15 is connected to the reference voltage generation circuit shown in FIG. 13.

FIG. 4 is a circuit diagram showing a bias circuit according to a third embodiment of the present invention. This circuit is formed by using a BiFET process. This bias circuit has such a configuration that a threshold voltage compensation circuit is added to the current-mirror-type bias circuit shown in FIG. 14.

In FIG. 4, Tr denotes an HBT; IN denotes an RF signal input terminal; OUT denotes an RF signal output terminal; C1 denotes a capacitor; and Vc denotes a power supply terminal. These are components of an amplification stage. Also, F5 to F7 denote depletion mode FETs; Tr5 and Tr6 denote HBTs; R7 to R12 denote resistors; Vcb denotes a power supply terminal; Ven denotes an enable terminal; and Vref denotes a reference voltage terminal. These are components of a bias circuit.

F5 has its gate connected to the terminal Ven through R7, and its drain connected to the power supply terminal Vcb. F6 has its drain connected to the source of F5, and its gate connected to the terminal Vref through R8 and R9. D1 has its anode connected to the source of F6. Tr5 has its collector connected to the gate of F6 through R8, its base connected to the cathode of D1, and its emitter grounded. This bias circuit outputs the voltage on the cathode side of D1 as a bias voltage through R10.

The threshold voltage compensation circuit in the present embodiment has F7, R11, R12 and Tr6. F7 has its drain connected to the cathode of D1 and to the base of Tr5 through R11. Tr6 has its base and collector connected to the gate of F7 and also to the source of F7 through R12. Tr6 has its emitter grounded. The resistors R11 and R12 may be removed, depending on the design.

When the threshold voltage Vth of the depletion mode FETs becomes deeper, the source current of F6 increases. At this time, the current flowing through the threshold voltage compensation circuit also increases, thereby suppressing an increase in the base current Ib of the Tr in the amplification stage. A circuit simulation was performed to find that variation in collector current Ic can be suppressed to about ⅕ to ⅙ or less (±5 to 6 mA or less with respect to the standard current 40 mA) in the present embodiment in comparison with the case where the threshold voltage compensation circuit is not used (variation of about ±30 mA with respect to the standard current 40 mA). Thus, the circuit according to the present embodiment can suppress a variation in gain due to a process variation. Also, the circuit according to the present embodiment has a shutdown mode, as does that in the first embodiment.

Fourth Embodiment

Figure 5:
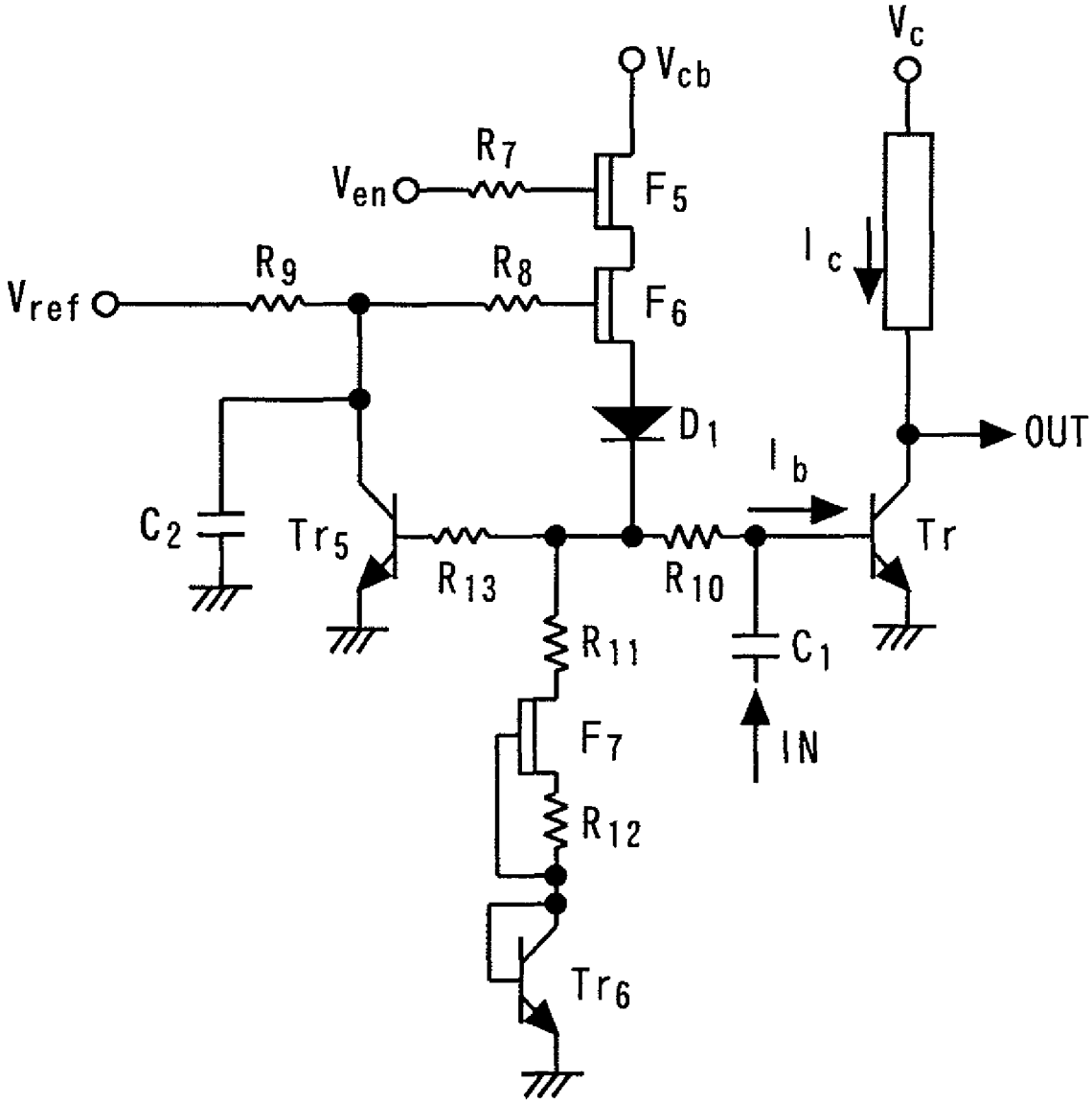
FIG. 5 is a circuit diagram showing a bias circuit according to a fourth embodiment of the present invention.

FIG. 5 is a circuit diagram showing a bias circuit according to a fourth embodiment of the present invention. This bias circuit has such a configuration that a capacitor C2 and a resistor R13 are added to the third embodiment. One end of C2 is connected to the collector of Tr5, while the other end of C2 is grounded. R13 is connected between the cathode of D1 and the base of Tr5.

Addition of the capacitor C2 and the resistor R13 enables suppression of a reduction in the bias voltage between the base and the emitter of Tr5 due to an RF signal leakage during the power amplifying operation of Tr. Consequently, a reduction in saturated output power during the power amplifying operation of Tr in the amplification stage can be suppressed. Other advantages, which are the same those of the third embodiment, can also be obtained.

Fifth Embodiment

Figure 6:
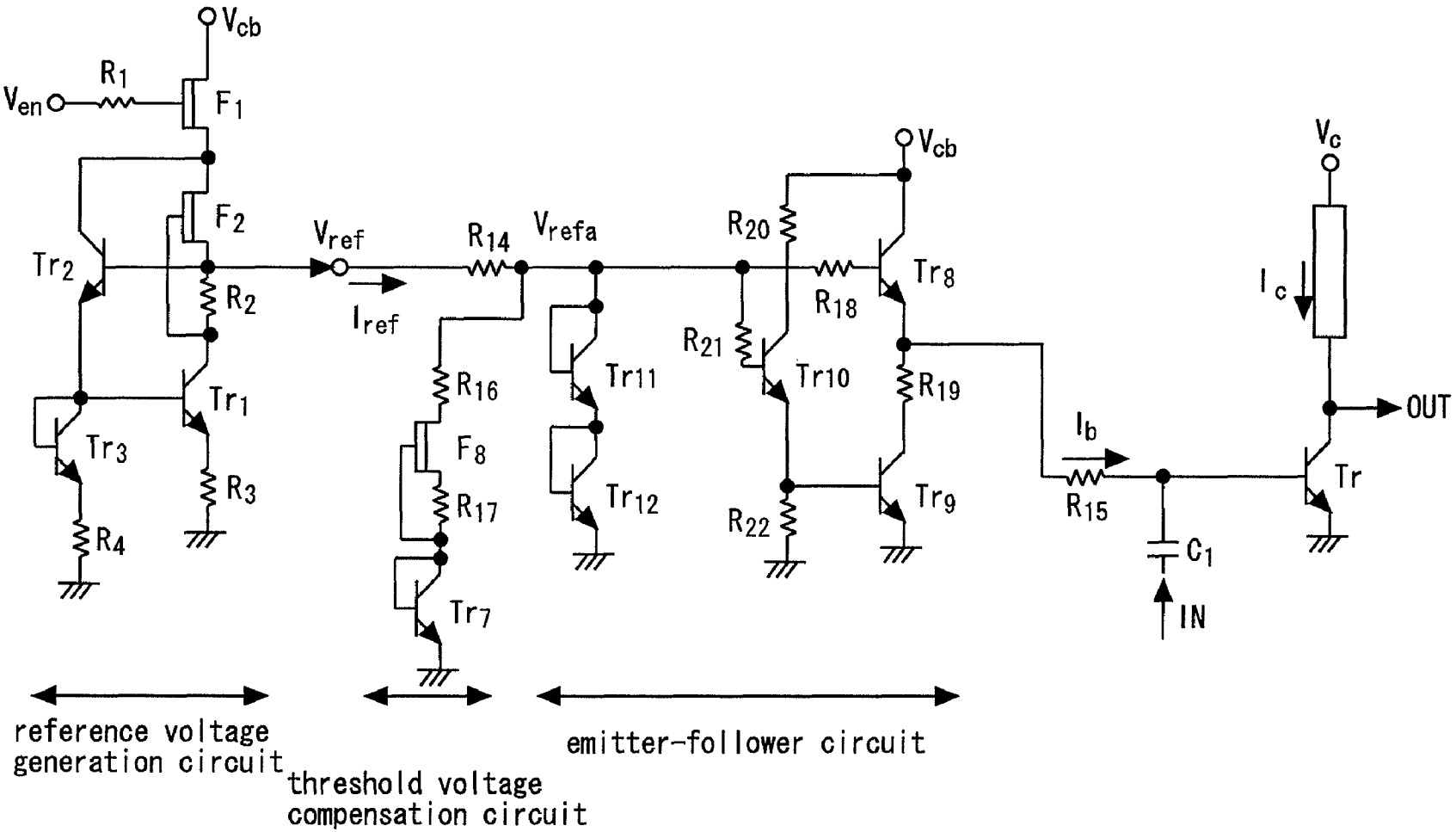
FIG. 6 is a circuit diagram showing a bias circuit according to a firth embodiment of the present invention.

FIG. 6 is a circuit diagram showing a bias circuit according to a firth embodiment of the present invention. This circuit is formed by using a BiFET process. This circuit has the same reference voltage generation circuit as that shown in FIG. 1 (except that the threshold voltage compensation circuit is not provided), an emitter-follower circuit (amplification circuit) and a threshold voltage compensation circuit. In FIG. 6, F8 denotes a depletion mode FET; Tr7 to Tr12 denote HBTs; and R16 to R22 denote resistors.

One end of R14 is connected to the source of F2 and to one end of R2 through the terminal Vref. An input of the emitter-follower circuit is connected to the other end of R14. To the emitter-follower circuit, the reference voltage generated in the reference voltage generation circuit is input through the terminal Vref and the resistor R14. This bias circuit outputs an output voltage of the emitter-follower circuit as a bias voltage through R15.

The threshold voltage compensation circuit in the present embodiment has F8, R16, R17 and Tr7. F8 has its drain connected to the input of the emitter-follower circuit through R16. Tr7 has its base and collector connected to the gate of F8 and also to the source of F8 through R17. Tr7 has its emitter grounded. The resistors R16 and R17 may be removed, depending on the design.

The emitter-follower circuit has Tr8 to Tr12 and R18 to R22. Tr8 has its collector connected to the power supply terminal Vcb, and its base connected to the other end of R14 through R18. Tr9 has its collector connected to the emitter of Tr8 through R19, and its emitter grounded. Tr10 has its collector connected to the power supply terminal Vcb through R20, its base connected to the other end of R14 through R21, and its emitter connected the base of Tr9 and grounded through R22. Tr11 has its base and collector connected to the other end of R14. Tr12 has its base and collector connected to the emitter of Tr11, and its emitter grounded.

When the threshold voltage Vth of the depletion mode FETs becomes deeper, the source voltage of F2 (reference voltage) increases. At this time, the current flowing through the threshold voltage compensation circuit also increases. As a result, a voltage drop caused across R14 increases with the change in the threshold voltage Vth. An increase in voltage Vrefa at the input of the emitter follower circuit is thereby suppressed. In this way, an increase in base current Ib of Tr in the amplification stage can be suppressed. Thus, the circuit according to the present embodiment is capable of suppressing a variation in gain due to a process variation. Also, the circuit according to the present embodiment has a shutdown mode, as does that in the first embodiment.

Sixth Embodiment

Figure 7:
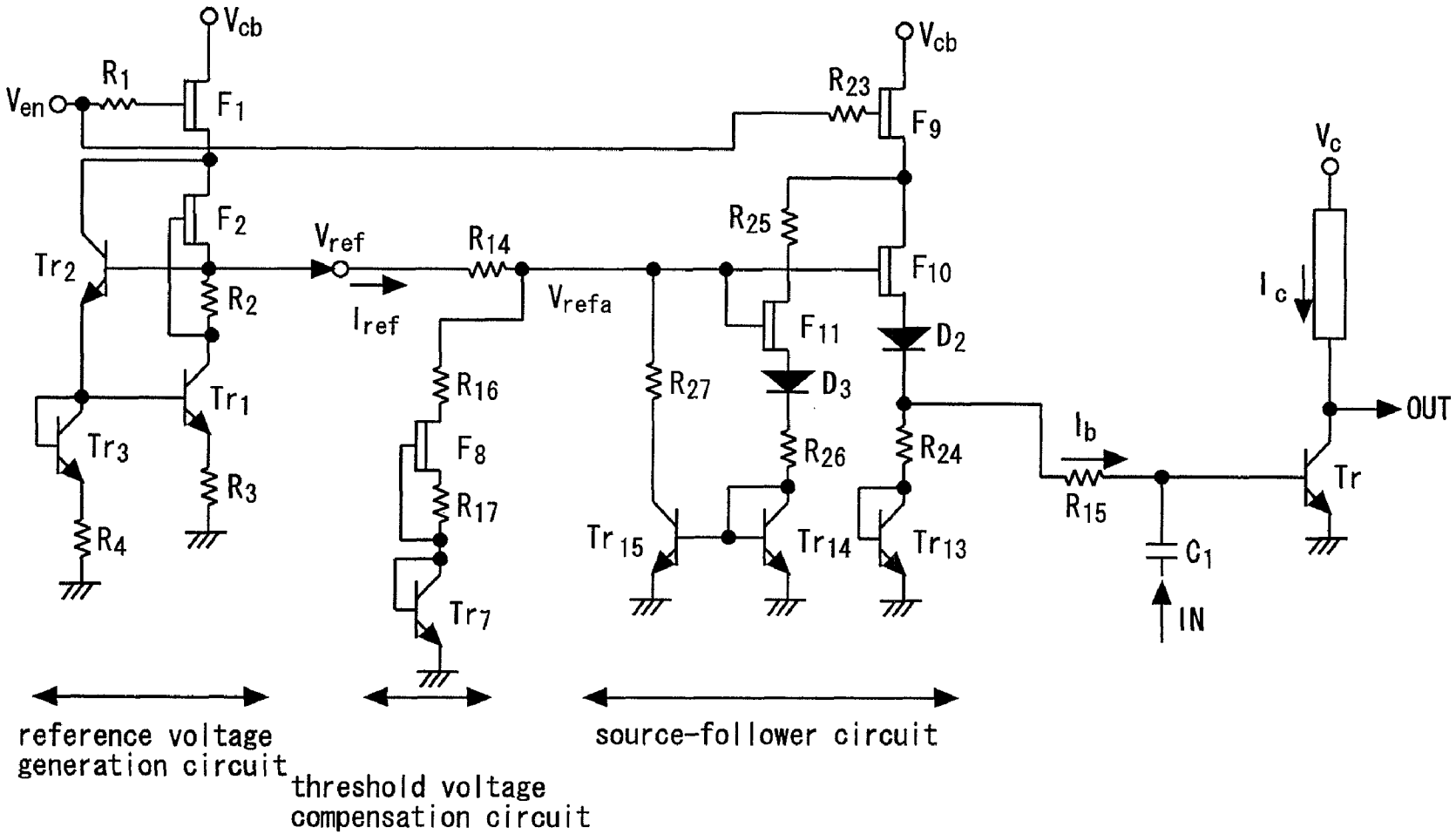
FIG. 7 is a circuit diagram showing a bias circuit according to a sixth embodiment of the present invention.

FIG. 7 is a circuit diagram showing a bias circuit according to a sixth embodiment of the present invention. This circuit is formed by using a BiFET process. This circuit has the same reference voltage generation circuit as that shown in FIG. 1 (except that the threshold voltage compensation circuit is not provided), a source-follower circuit (amplification circuit) and a threshold voltage compensation circuit. In FIG. 7, F9 to F11 denote depletion mode FETs; Tr13 to Tr15 denote HETs; R23 to R27 denote resistors; and D2 and D3 denote diodes.

The circuit according to the present embodiment has such a configuration that the emitter-follower circuit of the fifth embodiment is replaced with a source-follower circuit. An input of the source-follower circuit is connected to the other end of R14. To the source-follower circuit, the reference voltage generated in the reference voltage generation circuit is input through the terminal Vref and the resistor R14. This bias circuit outputs an output voltage of the source-follower circuit as a bias voltage through R15.

The source-follower circuit has F9 to F11, Tr13 to Tr15, R23 to R27, D2 and D3. F9 has its drain connected to the power supply terminal Vcb, and its gate connected to the terminal Ven through R23. F10 has its drain connected to the source of F9, and its gate connected to the other end of R14. D2 has its anode connected to the source of F10. Tr13 has its base and collector connected to the cathode of D2 through R24, and its emitter grounded. F11 has its drain connected to the source of F9 through R25, and its gate connected to the other end of R14. D3 has its anode connected to the source of F11. Tr14 has its base and collector connected to the cathode of D3 through R26, and its emitter grounded. Tr15 has its collector connected to the other end of R14 through R27, its base connected to the base and collector of Tr14, and its emitter grounded.

The circuit according to the present embodiment is capable of suppressing a variation in gain due to a process variation, as is that in the fifth embodiment. Also, the circuit according to the present embodiment has a shutdown mode, as does that in the first embodiment.

Seventh Embodiment

Figure 8:
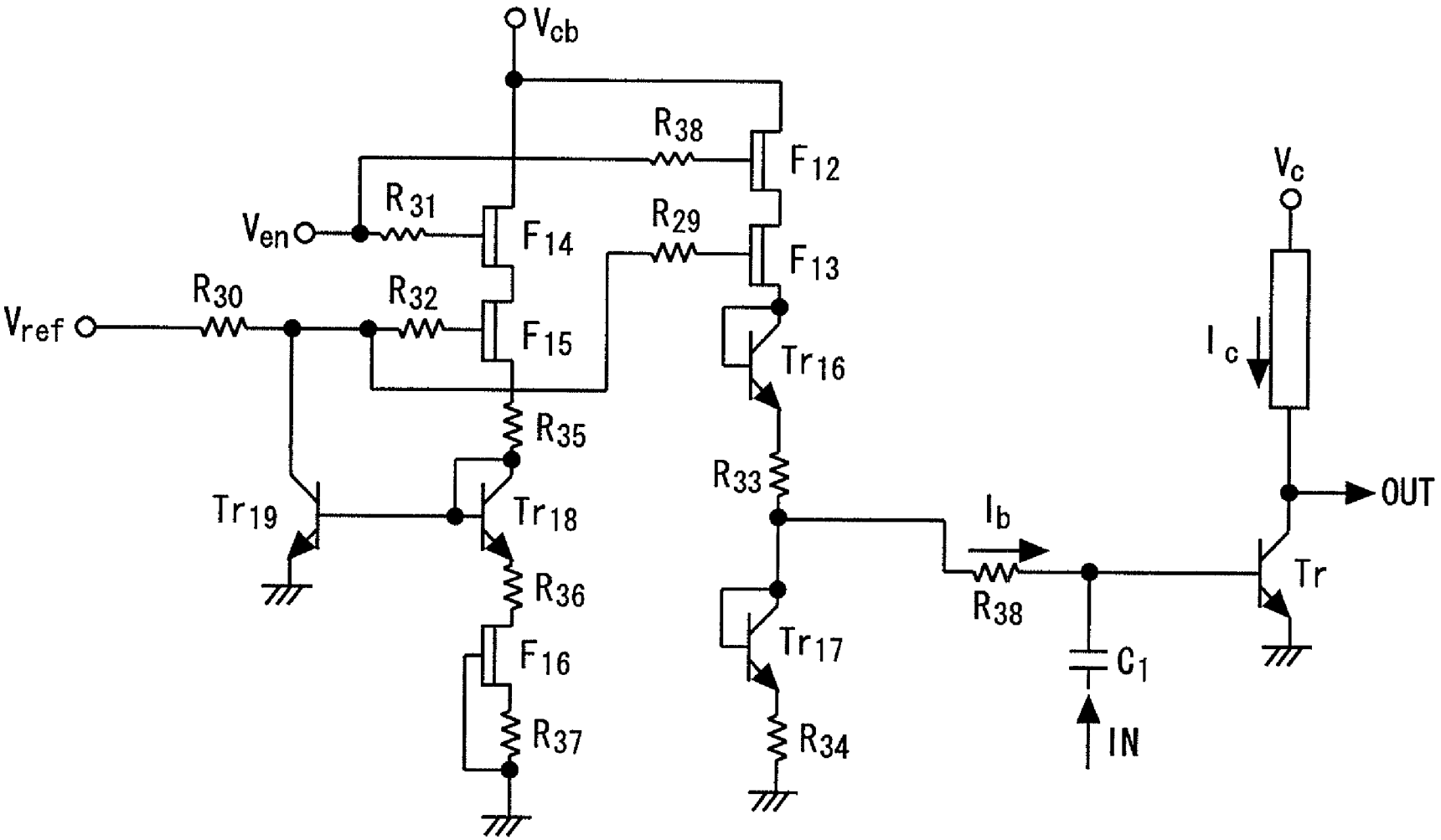
FIG. 8 is a circuit diagram showing a bias circuit according to a seventh embodiment of the present invention.

FIG. 8 is a circuit diagram showing a bias circuit according to a seventh embodiment of the present invention. This circuit is formed by using a BiFET process. This bias circuit has such a configuration that a source-follower circuit is added to a current-mirror-type bias circuit. In FIGS. 8, F12 to F16 denote depletion mode FETs; Tr16 to Tr19 denote HBTs; and R28 to R38 denote resistors.

F12 has its gate connected to the terminal Ven through R28, and its drain connected to the power supply terminal Vcb. F13 has its gate connected to the terminal Vref through R29 and R30, and its drain connected to the source of F12. F14 has its gate connected to the terminal Ven through R31, and its drain connected to the power supply terminal Vcb. F15 has its gate connected to the terminal Vref through R32 and R30, and its drain connected to the source of F14.

Tr16 has its base and collector connected to the source of F13. Tr17 has its base and collector connected to the emitter of Tr16 through R33, and its emitter grounded. Tr18 has its base and collector connected to the source of F15 through R35. Tr19 has its collector connected to the terminal Vref through R30, to the gate of F13 through R29, and to the gate of F15 through R32. Tr19 has its base connected to the base and the collector of Tr18, and its emitter grounded. F16 has its drain connected to the emitter of Tr18 through R36, its gate grounded, and its source grounded through R37. This bias circuit outputs the collector voltage of Tr17 as a bias voltage through R38.

The threshold voltage compensation circuit in the present embodiment has F16, R36, R37, and Tr18. The resistors R36 and R37 may be removed, depending on the design. The threshold voltage compensation circuit is incorporated in the current-mirror circuit in this way to enable suppression of variation in the source current of F15 with respect to variation in the threshold voltage Vth of the depletion mode FETs, as in the third embodiment. With this arrangement, suppression of variation in the source current of F13 sharing the same gate voltage with F15 is also enabled. Suppression of an increase in the base current Ib of Tr in the amplification stage is enabled thereby. Thus, the circuit according to the present embodiment is capable of suppressing a variation in gain due to a process variation. Also, the circuit according to the present embodiment has a shutdown mode, as does that in the first embodiment.

Eighth Embodiment

Figure 9:
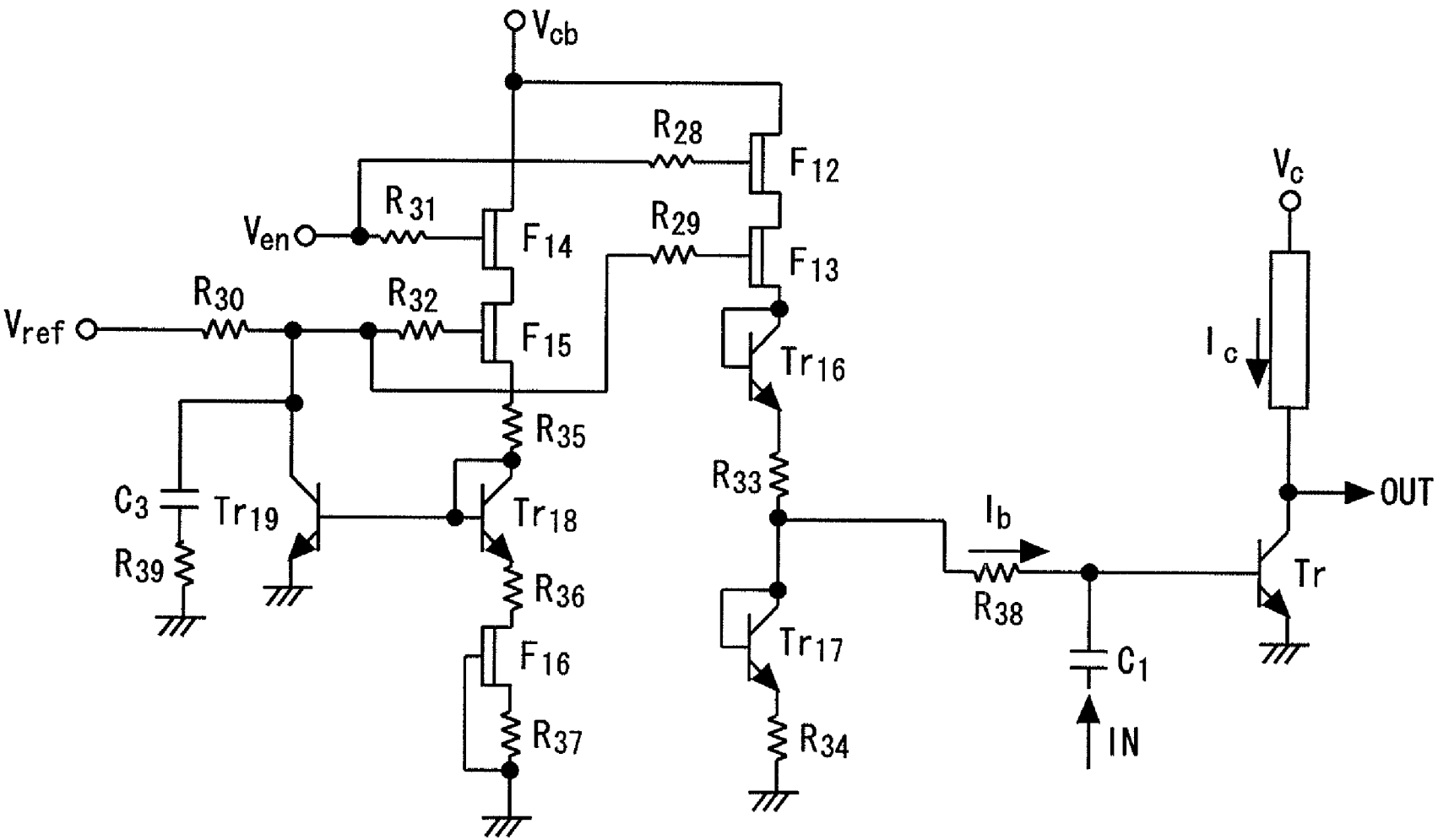
FIG. 9 is a circuit diagram showing a bias circuit according to an eighth embodiment of the present invention.

FIG. 9 is a circuit diagram showing a bias circuit according to an eighth embodiment of the present invention. This circuit has such a configuration that a capacitor C3 and a resistor R39 are added to the circuit in the seventh embodiment. One end of C3 is connected to the collector of Tr19, while the other end of C3 is grounded through R39.

Addition of the capacitor C3 and the resistor R39 enables suppression of a reduction in the bias voltage between the base and the emitter of Tr19 due to an RF signal leakage during the power amplifying operation of Tr in the amplification stage. Consequently, a reduction in saturated output power during the power amplifying operation of Tr in the amplification stage can be suppressed. Other advantages, which are the same those of the seventh embodiment, can also be obtained.

Ninth Embodiment

Figure 10:
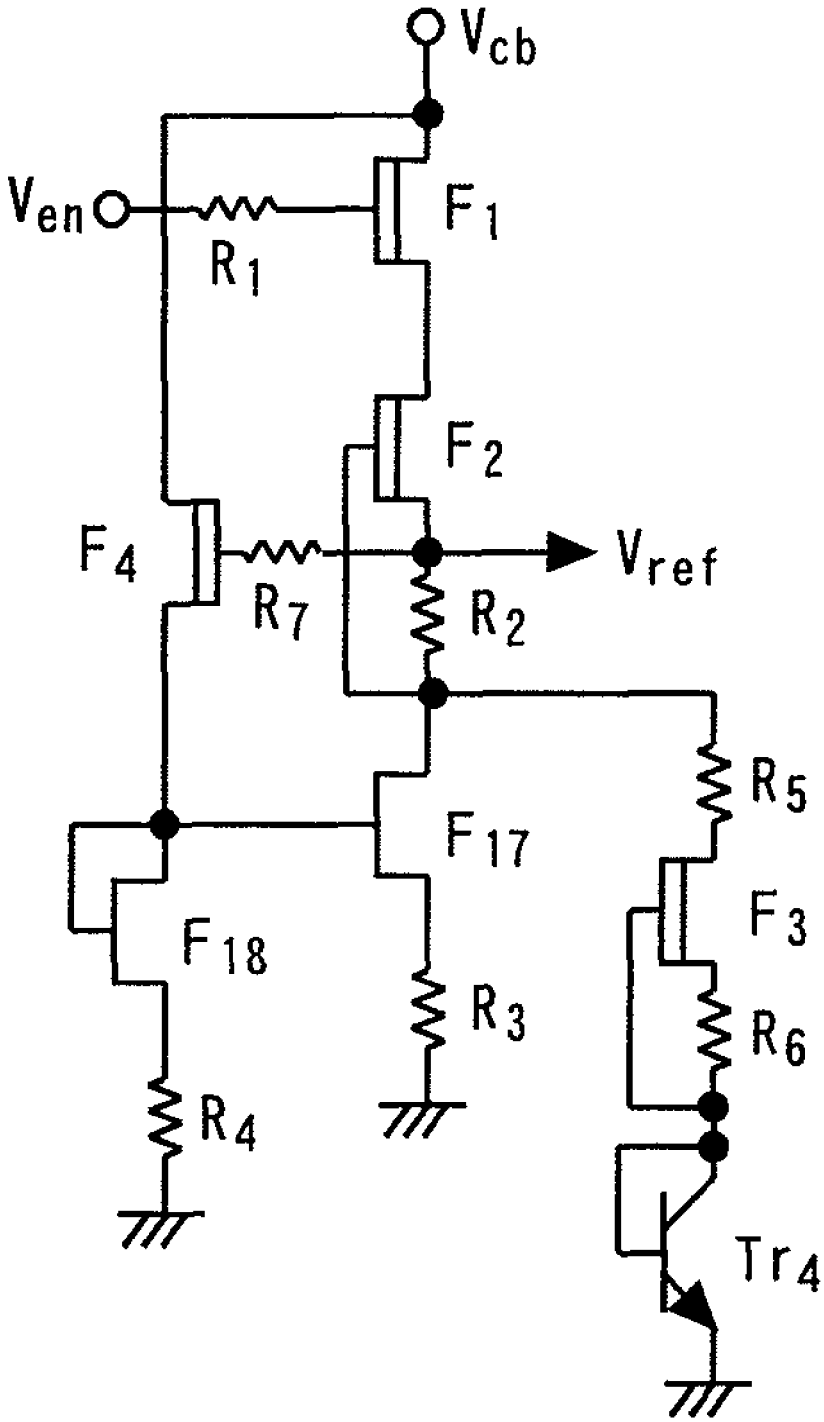
FIG. 10 is a circuit diagram showing a reference voltage generation circuit according to a ninth embodiment of the present invention.

FIG. 10 is a circuit diagram showing a reference voltage generation circuit according to a ninth embodiment of the present invention. This circuit is formed by using a BiFET process. This circuit has such a configuration that Tr1 and Tr3 in the second embodiment are replaced with F17 and F18 which are enhancement-mode FETs.

More specifically, F17 has its drain connected to the other end of R2, its source connected to one end of R3. F18 has its gate and drain connected to the gate of F17 and the source of F4. One end of R4 is connected to the source of F18. The drain of F17 is connected to the drain of F3 through R5. In other respects, the configuration is the same as that in the second embodiment.

Suppression of a leak current to a practical level requires reducing the ON voltage Va in the enable voltage to about 1.4 V. In view of this, in the present embodiment, enhancement-mode FETs are used to achieve a further reduction in voltage Va. According to a circuit simulation, the voltage Va can be reduced to about 1.0 V. Also, since the enhancement-mode FETs is formed by current mirrors, the circuit is theoretically unsusceptible to variation in the threshold voltage of the enhancement-mode FETs. Other advantages, which are the same those of the second embodiment, can also be obtained.

Tenth Embodiment

Figure 11:
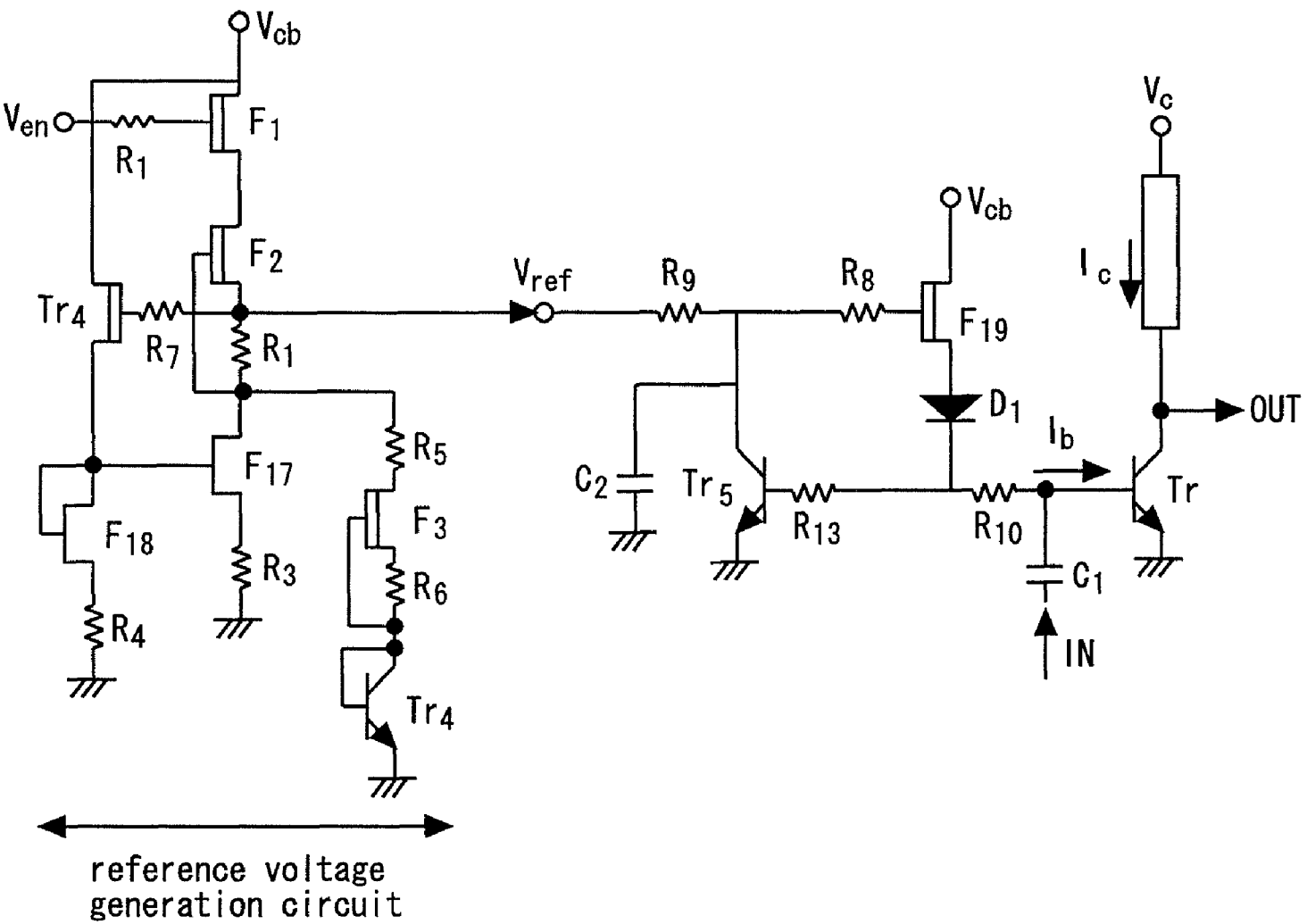
FIG. 11 is a circuit diagram showing a bias circuit according to a tenth embodiment of the present invention.
Figure 12:
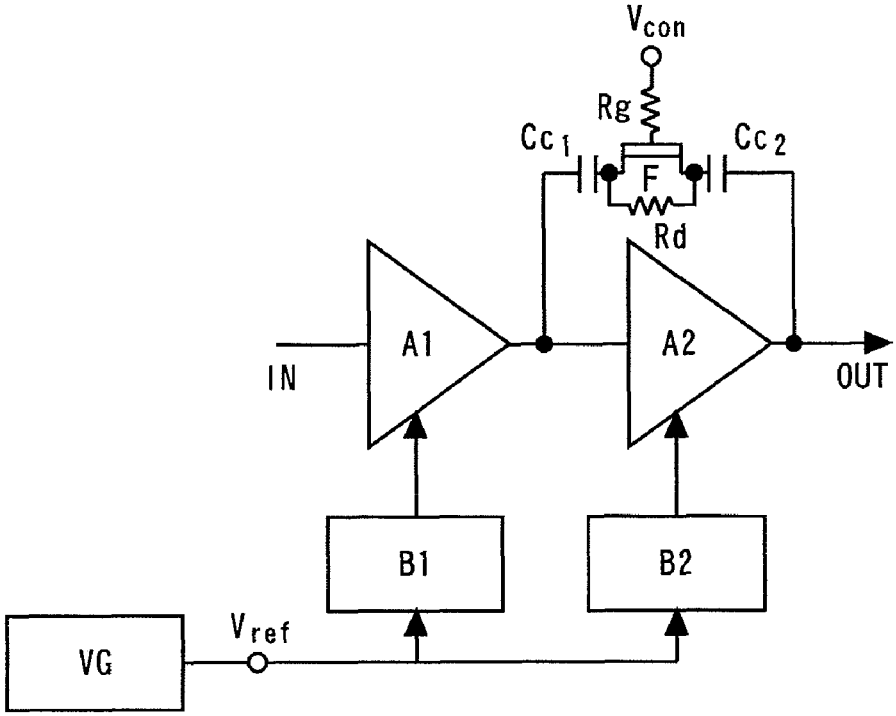
FIG. 12 CONVENTIONAL ART
FIG. 12 is a block diagram showing a GaAs power amplifier using a BiFET process.

FIG. 11 is a circuit diagram showing a bias circuit according to a tenth embodiment of the present invention. This circuit is formed by using a BiFET process. This bias circuit has such a configuration that the same current-mirror-type bias circuit as that in the fourth embodiment is connected to the reference voltage generation circuit in the ninth embodiment. In FIG. 11, F19 denotes an enhancement-mode FET.

A reference voltage generated by the reference voltage generation circuit is input through the terminal Vref. F19 has its drain connected to the power supply terminal Vcb, its gate connected to the terminal Vref through R8 and R9. The anode of D1 is connected to the source of F19. Tr5 has its collector connected to the gate of F19 through R8, its base connected to the cathode of D1 through R13, and its emitter grounded. One end of C2 is connected to the collector of Tr5, while the other end of C2 is grounded. This bias circuit outputs the voltage on the cathode side of D1 as a bias voltage through R10.

In the present embodiment, F19, which is an enhancement-mode FET, is used in place of F6 in the fourth embodiment. In the fourth embodiment, there is a need to provide F5 on the drain side of F6 for the purpose of suppressing a leak current. In the present embodiment, a leak current can be sufficiently suppressed by using the enhancement-mode FET and, therefore, the arrangement without F5 in the fourth embodiment may suffice. The size of the circuit can therefore be reduced. Other advantages, which are the same those of the ninth embodiment, can also be obtained.

Obviously many modifications and variations of the present invention are possible in the light of the above teachings. It is therefore to be understood that within the scope of the appended claims the invention may be practiced otherwise than as specifically described.

The entire disclosure of a Japanese Patent Application No. 2008-298431, filed on Nov. 21, 2008 including specification, claims, drawings and summary, on which the Convention priority of the present application is based, are incorporated herein by reference in its entirety.

What is claimed is:

1. A reference voltage generation circuit comprising:

a first depletion mode field effect transistor (FET) having a source, a drain, and a gate, with the gate connected to an enable terminal, and the drain connected to a power supply terminal;

a second depletion mode FET having a source, a drain, and a gate, with the drain connected to the source of the first depletion mode FET;

a first resistor having a first end connected to the source of the second depletion mode FET, and a second end connected to the gate of the second depletion mode FET;

a first bipolar transistor having an emitter, a base, and a collector, with the collector connected to the second end of the first resistor;

a second resistor having a first end connected to the emitter of the first bipolar transistor, and a second end that is grounded;

a second bipolar transistor having an emitter, a base, and a collector, with the collector connected to the source of the first depletion mode FET, and the base connected to the source of the second depletion mode FET;

a third bipolar transistor having an emitter, a base, and a collector, with the base and collector connected to the base of the first bipolar transistor and to the emitter of the second bipolar transistor;

a third resistor having a first end connected to the emitter of the third bipolar transistor, and a second end that is grounded;

a third depletion mode FET having a source, a drain, and a gate, with the drain connected to the second end of the first resistor and to the collector of the first bipolar transistor; and a fourth bipolar transistor having an emitter, a base, and a collector, with the base and collector connected to the gate and the source of the third depletion mode FET, and the emitter grounded, wherein source voltage of the second depletion mode FET is output as a reference voltage.

2. A reference voltage generation circuit comprising:

a first depletion mode field effect transistor (FET) having a source, a drain, and a gate, with the gate connected to an enable terminal, and the drain connected to a power supply terminal;

a second depletion mode FET having a source, a drain, and a gate, with the drain connected to the source of the first depletion mode FET;

a first resistor having a first end connected to the source of the second depletion mode FET, and a second end connected to the gate of the second depletion mode FET;

a first bipolar transistor having an emitter, a base, and a collector with the collector connected to the second end of the first resistor;

a second resistor having a first end connected to the emitter of the first bipolar transistor, and a second end that is grounded;

a third depletion mode FET having a source, a drain, and a gate, with the drain connected to the power supply terminal, and its gate connected to the source of the second depletion mode FET;

a second bipolar transistor having an emitter, a base, and a collector, with the base and collector connected to the base of the first bipolar transistor and to the source of the third depletion mode FET;

a third resistor having a first end connected to the emitter of the second bipolar transistor, and a second end that is grounded;

a fourth depletion mode FET having a source, a drain, and a gate, with the drain connected to the second end of the first resistor and to the collector of the first bipolar transistor; and a third bipolar transistor having an emitter, a base, and a collector, with the base and collector connected to the gate and the source of the fourth depletion mode FET, and the emitter grounded, wherein source voltage of the second depletion mode FET is output as a reference voltage.

3. A bias circuit comprising:

a first depletion mode FET having a source, a drain, and a gate, with the gate connected to an enable terminal, and the drain connected to a power supply terminal;

a second depletion mode FET having a source, a drain, and a gate, with the drain connected to the source of the first depletion mode FET, and the gate connected to a reference voltage terminal;

a diode having an anode and a cathode, with the anode connected to the source of the second depletion mode FET;

a first bipolar transistor having an emitter, a base, and a collector, with the collector connected to the gate of the second depletion mode FET, the base connected to the cathode of the diode, and the emitter grounded;

a third depletion mode FET having a source, a drain, and a gate, with the drain connected to the cathode of the diode and to the base of the first bipolar transistor; and a second bipolar transistor having an emitter, a base, and a collector, with the base and the collector connected to the gate and the source of the third depletion mode FET, and the emitter grounded, wherein voltage on the cathode of the diode is output as a bias voltage.

4. The bias circuit according to claim 3, further comprising a capacitor having a first end connected to the collector of the first bipolar transistor, and a second end that is grounded.

5. A bias circuit comprising:

a first depletion mode FET having a source, a drain, and a gate, with the gate connected to an enable terminal, and the drain connected to a power supply terminal;

a second depletion mode FET having a source, a drain, and a gate, with the drain connected to the source of the first depletion mode FET;

a first resistor having a first end connected to the source of the second depletion mode FET, and a second end connected to the gate of the second depletion mode FET;

a first bipolar transistor having an emitter, a base, and a collector, with the collector connected to the second end of the first resistor;

a second resistor having a first end connected to the emitter of the first bipolar transistor, and a second end that is grounded;

a second bipolar transistor having an emitter, a base, and a collector, with the collector connected to the source of the first depletion mode FET, and the base connected to the source of the second depletion mode FET;

a third bipolar transistor having an emitter, a base, and a collector, with the base and the collector connected to the base of the first bipolar transistor and to the emitter of the second bipolar transistor;

a third resistor having a first end connected to the emitter of the third bipolar transistor, and a second end that is grounded;

a fourth resistor having a first end connected to the source of the second depletion mode FET and to the first end of the first resistor;

an amplification circuit having an input connected to a second end of the fourth resistor;

a third depletion mode FET having a source, a drain, and a gate, with the drain connected to the input of the amplification circuit; and a fourth bipolar transistor having an emitter, a base, and a collector, with the base and the collector connected to the gate and the source of the third depletion mode FET, and the emitter grounded, wherein the amplification circuit outputs a bias voltage.

6. A bias circuit comprising:

a first depletion mode FET having a source, a drain, and a gate, with the gate connected to an enable terminal, and the drain connected to a power supply terminal;

a second depletion mode FET having a source, a drain, and a gate, with the gate connected to a reference voltage terminal, and the drain connected to the source of the first depletion mode FET;

a third depletion mode FET having a source, a drain, and a gate, with the gate connected to the enable terminal, and the drain connected the power supply terminal;

a fourth depletion mode FET having a source, a drain, and a gate, with the gate connected to the reference voltage terminal, and the drain connected to a source of the third depletion mode FET;

a first bipolar transistor having an emitter, a base, and a collector, with the base and the collector connected to the source of the second depletion mode FET, and the emitter grounded;

a second bipolar transistor having an emitter, a base, and a collector, with the collector and the base connected to the source of the fourth depletion mode FET;

a third bipolar transistor having an emitter, a base, and a collector, with the collector connected to the reference voltage terminal, to the gate of the second depletion mode FET, and to the gate of the fourth depletion mode FET, the base connected the base and the collector of the second bipolar transistor, and the emitter grounded; and a fifth depletion mode FET having a source, a drain, and a gate, with the drain connected to the emitter of the second bipolar transistor, and the gate and the source grounded, wherein collector voltage of the first bipolar transistor is output as a bias voltage.

7. The bias circuit according to claim 6, further comprising a capacitor having a first end connected to the collector of the third bipolar transistor, and a second end that is grounded.

8. A reference voltage generation circuit comprising:

a first depletion mode FET having a source, a drain, and a gate, with the gate connected to an enable terminal, and the drain connected to a power supply terminal;

a second depletion mode FET having a source, a drain, and a gate, with the drain connected to the source of the first depletion mode FET;

a first resistor having a first end connected to the source of the second depletion mode FET, and a second end connected to the gate of the second depletion mode FET;

a first enhancement-mode FET having a source, a drain, and a gate, with the drain connected to the second end of the first resistor;

a second resistor having a first end connected to the source of the first enhancement-mode FET, and a second end that is grounded;

a third depletion mode FET having a source, a drain, and a gate, with the drain connected to the power supply terminal, and the gate connected to the source of the second depletion mode FET;

a second enhancement-mode FET having a source, a drain, and a gate, with the gate and the drain connected to the gate of the first enhancement-mode FET and to the source of the third depletion mode FET;

a third resistor having a first end connected to the source of the second enhancement-mode FET, and a second end that is grounded;

a fourth depletion mode FET having a source, a drain, and a gate, with the drain connected to the second end of the first resistor and to the drain of the first enhancement-mode FET; and a first bipolar transistor having an emitter, a base, and a collector, with the base and collector connected to the gate and the source of the fourth depletion mode FET, and the emitter grounded, wherein source voltage of the second depletion mode FET is output as a reference voltage.

9. A bias circuit comprising:

the reference voltage generation circuit according to claim 8;

a reference voltage terminal through which a reference voltage generated by the reference voltage generation circuit is input;

a third enhancement-mode FET having a source, a drain, and a gate, with the drain connected to the power supply terminal, and the gate connected to the reference voltage terminal;

a diode having an anode and a cathode, with the anode connected to the source of the third enhancement-mode FET; and a second bipolar transistor having an emitter, a base, and a collector, with the collector connected to the gate of the third enhancement-mode FET, the base connected to the cathode of the diode, and the emitter grounded, wherein voltage on the cathode of the diode is output as a bias voltage.

* * * * *